US005467756A

United States Patent [19]

Fischer et al.

[11] Patent Number: 5,467,756

[45] Date of Patent: Nov. 21, 1995

[54] DEVICE FOR CONTROLLING AN AMOUNT OF EXHAUST GAS RETURNED TO AN ASPIRATING LINE

[75] Inventors: Jorg-Peter Fischer, Kirchheim; Steffen Mossner, Heilbronn, both of Germany

[73] Assignee: Robert Bosch GmbH, Stuttgart, Germany

[21] Appl. No.: 293,266

[22] Filed: Aug. 19, 1994

[30] Foreign Application Priority Data

Sep. 30, 1993 [DE] Germany ..... 43 33 295.1

[51] Int. Cl.[6] ..... F02M 25/07

[52] U.S. Cl. ..... 123/569

[58] Field of Search ..... 123/568, 569, 123/570, 571

[56] References Cited

U.S. PATENT DOCUMENTS

| | | | |
|---|---|---|---|
| 4,205,645 | 6/1980 | Eheim | 123/569 |
| 4,269,159 | 5/1981 | Skinner | 123/569 |
| 4,353,344 | 10/1982 | Bergmann et al. | 123/569 |
| 4,373,496 | 2/1983 | Greiner et al. | 123/569 |
| 4,466,415 | 8/1984 | Piesche | 123/569 |
| 4,479,473 | 10/1984 | Wade | 123/569 |
| 4,727,848 | 3/1988 | Stumpp et al. | 123/569 |

FOREIGN PATENT DOCUMENTS

| | | |
|---|---|---|
| 558358 | 9/1993 | European Pat. Off. . |
| 3619696 | 6/1987 | Germany . |
| 2946557 | 6/1988 | Germany . |

*Primary Examiner*—Willis R. Wolfe

*Attorney, Agent, or Firm*—Edwin E. Greigg; Ronald E. Greigg

[57] ABSTRACT

A device for controlling the amounts of returned exhaust gas, wherein an exhaust gas return valve in an exhaust gas return line is supplied with pressure from a pressure source via a control valve in such a way that the return of exhaust gas is stopped during full load operation and idle operation and is allowed during partial load operations. In this case the control valve is embodied as a ⅔-way valve which, when a fuel injection floating lever is displaced, is continuously displaced in one movement direction and controls the connection between the pneumatic servo motor and the pressure source as a function of the three switching positions of the control valve.

3 Claims, 1 Drawing Sheet

FIG. 1
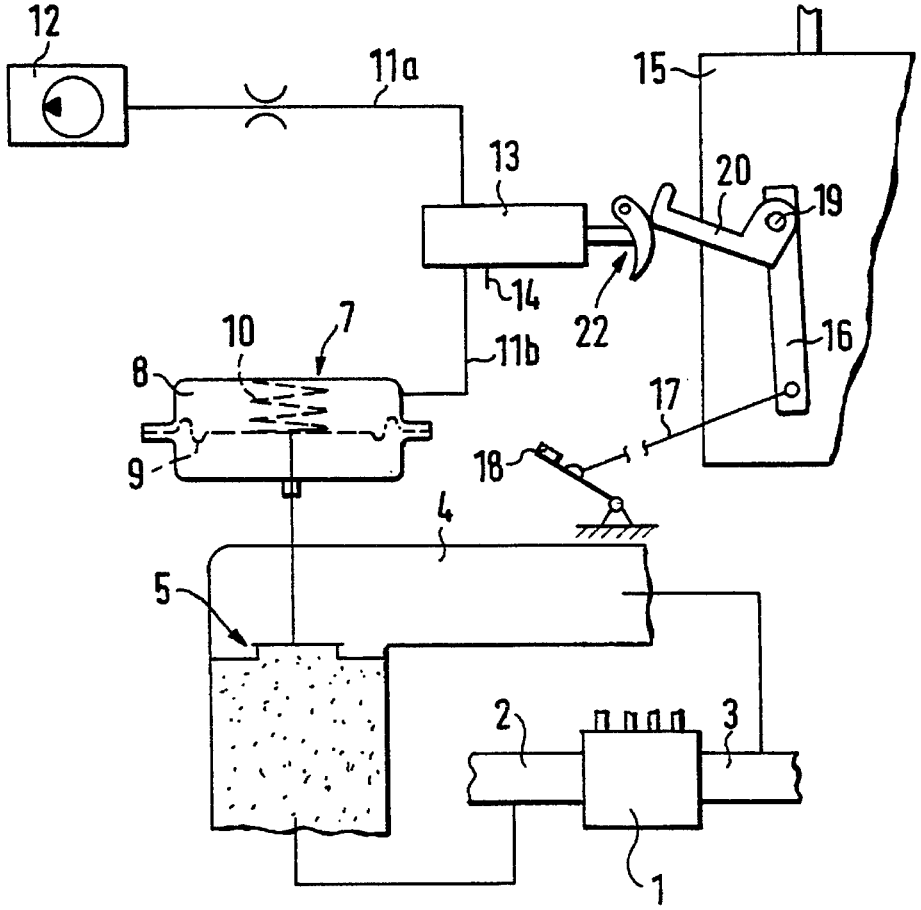
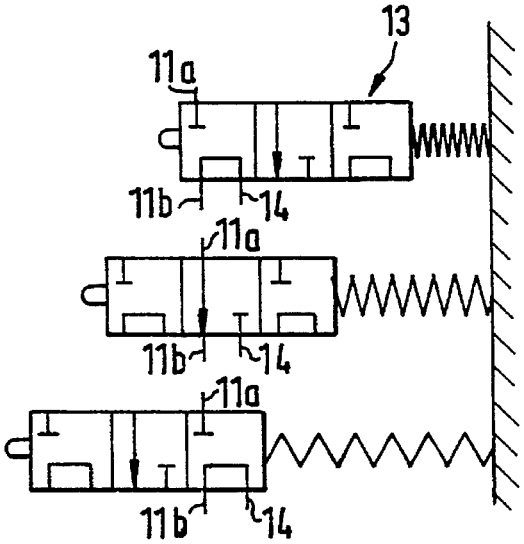
FIG. 2a
FIG. 2b
FIG. 2c

DEVICE FOR CONTROLLING AN AMOUNT OF EXHAUST GAS RETURNED TO AN ASPIRATING LINE

FIELD OF THE INVENTION

The invention relates to a device for controlling an amount of exhaust gas returned to an aspirating line.

BACKGROUND OF THE INVENTION

A device of this type is known from DE-A-29 46 557. With this known device a circuit is switched on with the aid of the radial cam connected with the adjustment lever, which controls a magnet valve embodied as a 3/2-way valve. It controls the pressure supply of the servo motor from an underpressure source in such a way that under full load the exhaust gas return valve, which is controlled by the servo motor, is closed and under partial load it is opened. This opening state is furthermore affected by a further pressure sensor as a function of the rpm in such a way that the exhaust gas return valve is opened only starting at defined low rpm.

This device is relatively expensive and also has the disadvantage that the further pressure sensor is disconnected from the position of the adjustment lever (the signal arrives independently of the position of the adjustment lever). In addition, two circuits are required: an electrical one for the magnet valve control and a pneumatic one for the adjustment unit ARF.

OBJECT AND SUMMARY OF THE INVENTION

In contrast to this, the device in accordance with the invention has the advantage that exact switch points between the first and second or second and third switching positions can be achieved by the control valve. The cam for actuating the control valve can be simply embodied because of its continuous cam path (direct intervention in the pneumatic circuit). In regard to their VH position, the switch points can be arbitrarily set and can be selected arbitrarily in relation to each other by adjustment mechanisms.

In an advantageous manner, the control valve is embodied as a 3/3-way valve.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 1 shows the schematic arrangement of the device for controlling the amount of returned exhaust gas, and FIGS. 2*a*, 2*b* and 2*c* shows the three switching positions of the control valve in accordance with the respective load conditions of idle, partial load and full load.

DESCRIPTION OF THE PREFERRED EMBODIMENT

FIG. 1 symbolically shows an internal combustion engine 1 with an exhaust gas collecting line 2 and an aspirating line 3, which is connected via an exhaust gas return line 4 with the exhaust gas collecting line. An exhaust gas return valve 5 has been installed in the exhaust gas return line, which is operated from a regulating device consisting of a pneumatic regulating flap 7. It has a work chamber 8 which is bounded by a regulating diaphragm 9 connected with the exhaust gas return valve and which is loaded by a spring 10 acting in the closing direction of the exhaust gas return valve 4. The work chamber 8 is connected with an underpressure source 12 via a pressure line 11. A control valve 13 is disposed in the pressure line 11, which divides the pressure line 11 into a pressure line segment 11*a* leading to the underpressure source 12 and a pressure line segment 11*b* leading to the work chamber 8.

The internal combustion engine is supplied with fuel by a fuel injection pump 15, a part of which is represented in FIG. 1. As customarily provided, this fuel injection pump also has a floating lever 16 for adjusting the amount of fuel to be injected, which is connected via a linkage or a cable pull 17 with the actuation member 18, customarily called a gas pedal. By means of this the driver of a motor vehicle which is operated by means of an internal combustion engine can set the desired torque or speed. The amount of injected fuel is correspondingly changed via the floating lever 16 and a shaft leading from there into the interior of the fuel injection valve. Furthermore a cam 20, which can also be embodied as a single lever, as shown in FIG. 1, is also located on the shaft 19 on which the floating lever is fixed. This cam 20 acts on an actuation member 22 of the control valve 13. When the floating lever is displaced, the cam 20 follows along a continuously rising or falling cam course in relation to the actuation member 22 of the control valve 13. This is done in such a way that when the floating lever is displaced from an idle position to a full load position, resulting in a larger amount of injected fuel, the actuation member 22 is moved continuously by the cam 20, for example outward.

The control valve 13 is a 3/3-way valve which is shown in FIGS. 2*a*, 2*b* and 2*c*, symbolically in its three positions. In this case, when the internal combustion engine is idling, the control valve, in a position corresponding to the idle position of the floating lever 16, connects the pressure line 11*b* with the connection opening 14 to a reference pressure, in this case the pressure of the ambient air. As a result, the work chamber 8 is placed at the same pressure as the other chamber bordering the diaphragm 9 on the other side, which is also subjected to ambient pressure. Accordingly, the spring 10 moves the diaphragm 9 and thus the valve member of the exhaust gas return valve 5 into its closed position, so that no exhaust gas return takes place.

In the partial load position of the gas pedal 18 or of the floating lever 16, the control valve attains its second switching position, in which the pressure line segment 11*a* is connected with the pressure line segment 11*b* and the connection of the work chamber 8 with the ambient air is broken. Accordingly, underpressure from the underpressure source 12 appears in the work chamber 8 and the diaphragm 9 is moved against the force of the spring 10, so that the exhaust gas return valve 5 is opened. Exhaust gas is returned in this partial load range.

In a third switching position of the valve 13 in accordance with full load operation, the pressure line segment 11*b* is again connected with the connection opening 14, so that pressure is again equalized in the work chamber 8 and both sides of the diaphragm 9 are affected by the ambient pressure, so that the spring 10 can close the exhaust gas return valve again. The connection with the underpressure source is broken, as in the first switching position.

The three switching positions of the valve have been shown in principle above in connection with a pressure source which supplies the regulating flap 7 with underpressure. In another embodiment of the servo motor and with a reversed switching logic it is possible to employ a pressure source which provides overpressure.

When the direction of actuation of the pneumatic servo motor is changed from the described example, it is then also necessary to reverse the switching logic in such a way that, as described, no exhaust gas is returned in the full load position and the idle position of the floating lever 16, while exhaust gas return is provided in the partial load position. Such control valves having exact switching positions are known, for example from German Published, Non-Examined Patent Application DE-OS 30 49 110, and allow the exact employment of an exhaust gas return in correspondence to the position of the floating lever 16.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A device for controlling the amounts of returned exhaust gas of a self-igniting internal combustion engine (1), supplied by a fuel injection pump (15), having an exhaust gas return valve (5) disposed in an exhaust gas return line (4) of the internal combustion engine, said gas return valve is operated by means of a pneumatic servo motor (7) having a work chamber (8) which is controlled by means of a control valve (13) which, in turn, is controlled as a function of a position of a floating lever (16) of the fuel injection pump (15) that controls the injection amount and which, depending on the switching position of the control valve, can be connected with either a control pressure source (12) or a reference pressure source, wherein the floating lever (16) is coupled with a control cam (20) which cooperates with an actuation member (22) of the control valve (13), the control cam describes a continuously increasing or decreasing cam course in relation to the actuation member (22), and the control valve is embodied in such a way that, with increasing actuation of the actuation member (22), the control valve attains three switching positions in sequence when the floating lever (16) moves from an idle position to a full load position, namely a first switching position in accordance with a first switching state, a second switching position in accordance with a second switching state and a third switching position in accordance with a third switching state, wherein the first switching state adjusts the control pressure in the work chamber (8) in such a way that the exhaust gas return valve (5) is closed, and wherein the second switching state sets the control pressure such that the exhaust gas return valve (5) is opened.

2. A device in accordance with claim 1, in which the control valve is a ⅔-way valve by means of which, in its first and third switching position corresponding to the first switching state, the servo motor (7) is connected with the pressure source (11), and in its second switching position corresponding to the second switching state, the servo motor is connected with the ambient air, wherein the servo motor closes the exhaust gas return valve (5) when charged with the pressure from the pressure source.

3. A device in accordance with claim 1, in which the control valve is a ⅔-way valve by means of which, in its first and third switching position corresponding to the first switching state, the servo motor is connected with the ambient air, and in its second switching position corresponding to the second switching state, the servo motor is connected with the pressure source, wherein the servo motor opens the exhaust gas return valve when charged with the pressure from the pressure source.

* * * * *